US006808595B1

(12) United States Patent
Burns et al.

(10) Patent No.: US 6,808,595 B1
(45) Date of Patent: Oct. 26, 2004

(54) SOFT PAPER PRODUCTS WITH LOW LINT AND SLOUGH

(75) Inventors: Barbara J. Burns, Aiken, SC (US); Daniel S. Westbrook, Sherwood, WI (US); Timothy M. McFarland, Neenah, WI (US); James M. Kaun, Neenah, WI (US); Werner F. W. Lonsky, Appleton, WI (US); Alberto R. Negri, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/688,332

(22) Filed: Oct. 10, 2000

(51) Int. Cl.[7] ..... D21H 11/20

(52) U.S. Cl. ..... 162/9; 162/72; 162/129; 162/130; 162/146; 162/157.6; 162/182

(58) Field of Search ..... 162/9, 72, 157.6, 162/146, 129, 130, 111, 112, 182

(56) References Cited

U.S. PATENT DOCUMENTS

| | | | | |
|---|---|---|---|---|
| 2,345,543 A | | 3/1944 | Wohnsiedler et al. | |
| 2,926,116 A | | 2/1960 | Keim | |
| 2,926,154 A | | 2/1960 | Keim | |
| 3,556,933 A | | 1/1971 | Williams et al. | |
| 3,700,623 A | | 10/1972 | Keim | |
| 3,772,076 A | | 11/1973 | Keim | |
| 4,603,176 A | | 7/1986 | Bjorkquist et al. | |
| 4,605,702 A | | 8/1986 | Guerro et al. | |
| 4,608,292 A | | 8/1986 | Lassen | |
| 4,675,394 A | | 6/1987 | Solarek et al. | |
| 4,701,237 A | | 10/1987 | Lassen | |
| 5,048,589 A | | 9/1991 | Cook et al. | |
| 5,129,988 A | | 7/1992 | Farrington, Jr. | |
| 5,399,412 A | | 3/1995 | Sudall et al. | |
| 5,405,501 A | * | 4/1995 | Phan et al. | 162/130 |
| 5,466,337 A | | 11/1995 | Darlington et al. | |
| 5,494,554 A | | 2/1996 | Edwards et al. | |
| 5,503,709 A | | 4/1996 | Burton | |
| 5,510,001 A | | 4/1996 | Hermans et al. | |
| 5,529,665 A | | 6/1996 | Kaun | |
| 5,558,873 A | | 9/1996 | Funk et al. | |
| 5,591,309 A | | 1/1997 | Rugowski et al. | |
| 5,620,565 A | * | 4/1997 | Lazorisak et al. | 162/72 |
| 5,759,926 A | | 6/1998 | Pike et al. | |
| 5,814,188 A | | 9/1998 | Vinson et al. | |
| 5,830,317 A | | 11/1998 | Vinson et al. | |
| 5,853,539 A | | 12/1998 | Smith et al. | |
| 5,865,949 A | * | 2/1999 | Pere et al. | 162/72 |
| 5,895,710 A | | 4/1999 | Sasse et al. | |
| 5,935,383 A | | 8/1999 | Sun et al. | |
| 5,935,883 A | | 8/1999 | Pike | |
| 5,990,283 A | | 11/1999 | Cosgrove et al. | |
| 5,993,602 A | | 11/1999 | Smith et al. | |
| 6,017,417 A | | 1/2000 | Wendt et al. | |
| 6,027,610 A | | 2/2000 | Back et al. | |
| 6,099,688 A | * | 8/2000 | Pere et al. | 162/72 |
| 6,117,664 A | | 9/2000 | Schülein et al. | |
| 6,241,849 B1 | | 6/2001 | Franks | |
| 6,319,361 B1 | * | 11/2001 | Smith et al. | 162/157.6 |
| 6,635,146 B2 | | 10/2003 | Lonsky et al. | |

FOREIGN PATENT DOCUMENTS

| | | |
|---|---|---|
| EP | 0045500 B1 | 2/1982 |
| JP | 3185197 | 8/1991 |
| WO | WO 9117243 A1 | 11/1991 |
| WO | WO 9613632 | 5/1996 |
| WO | WO 9727363 | 7/1997 |
| WO | WO 9817854 A1 | 4/1998 |
| WO | WO 9856981 | 12/1998 |
| WO | WO 03021033 | 3/2003 |

OTHER PUBLICATIONS

The Effect of Trichoderma Reesei Cellulases and Hemicellulases on the Paper Technical Properties of Never–Dried Bleached Kraft Pulp; T. Oksanen, et al.; Jul. 27, 1997.
Effects of Purified Trichoderma Reesei Cellulases on the Fiber Properties of Kraft Pulp; Jaakko, Pere, et al.; vol. 78, No. 6; Tappi Journal.
Modification of Mechanical Pulp Using Carbohydrate–Degrading Enzymers; J.D. Richardson, et al.; Journal of Pulp and Paper Science; vol. 24, No. 4; Apr. 1998. Upgrading Recycled Pulps Using Enzymatic Treatment; Gerhard Stork, et al.; vol. 78, No. 2; Tappi Journal.
Change in Properties of Different Recycled Pulps by Endoglucanase Treatment; G. Stork and J. Puls; Institute for Wood Chemistry and Chemical Technology of Wood; 1996.
Wet Tensile Breaking Strength of Paper and Paperboard; T 456 om–87; 1987.
Biochimica et Biophysica Acta Enzymology; vol. 139, 1967.
Effects of Enzymatic Modification on Radiata Pine Kraft Fibre Wall Chemistry and Physical Properties; Thomas Clark, et al.; Jul. 1997.
Modification of Douglas–fir Mechanical and Kraft Pulps by Enzyme Treatment; Shawn D. Mansfield, et al.; vol. 79, No. 8; Tappi Journal.
Physical Testing of Pulp Handsheets; T 220 sp–96; 1996.
Copper Number of Pulp, Paper and Paperboard; T 430 om–94; 1994.
Pulp & Paper Testing (J.E. Levlin L. Söderhjelm) Ser.: Papermaking Sci. & Technol., vol. 17, pp. 142–149 (1999).
Abstract of Japanese Patent No. JP8246368, Sep. 24, 1996.
"Zero–Span Breaking Strength of Pulp (Dry Zero–Span Tensite)," T231 cm–96; 1996.
"Internal Tearing Resistance of Paper (Elmendorf–type Method)," T414 cm–88; 1988.

* cited by examiner

*Primary Examiner*—Peter Chin
(74) *Attorney, Agent, or Firm*—Dority & Manning, P.A.

(57) ABSTRACT

A paper product containing hardwood fibers that are treated with certain hydrolytic enzymes, such as endo-glucanases, is provided. Moreover, the paper product includes other types of fibers, such as softwood fibers, that may also be treated with certain hydrolytic enzymes. In addition, other ingredients, such as cross-linking agents, debonders, strength agents, etc., can be applied to further enhance the properties of the paper product. In particular, paper products formed according to the present invention can be strong, soft, and have low lint and slough production.

41 Claims, 3 Drawing Sheets

SOFT PAPER PRODUCTS WITH LOW LINT AND SLOUGH

BACKGROUND OF THE INVENTION

In the manufacture of paper products, such as facial tissues, bath tissues, napkins, wipes, paper towels, etc., it is often desired to optimize various properties of the products. For example, the products should have good bulk, a soft feel, and should have good strength. Unfortunately, however, when steps are taken to increase one property of the product, other characteristics of the product are often adversely affected.

For instance, it is very difficult to produce a high strength paper product that is also soft. In particular, strength is typically increased by the addition of certain strength or bonding agents to the product. Although the strength of the paper product is increased, various methods are often used to soften the product that can result in decreased fiber bonding. For example, chemical debonders can be utilized to reduce fiber bonding and thereby increase softness. Moreover, mechanical forces, such as creping or calendering, can also be utilized to increase softness.

However, reducing fiber bonding with a chemical debonder or through mechanical forces can adversely affect the strength of the paper product. For example, hydrogen bonds between adjacent fibers can be broken by such chemical debonders, as well as by mechanical forces of a papermaking process. Consequently, such debonding results in loosely bound fibers that extend from the surface of the tissue product. During processing and/or use, these loosely bound fibers can be freed from the tissue product, thereby creating lint, which is defined as individual airborne fibers and fiber fragments. Moreover, papermaking processes may also create zones of fibers that are poorly bound to each other but not to adjacent zones of fibers. As a result, during use, certain shear forces can liberate the weakly bound zones from the remaining fibers, thereby resulting in slough, i.e., bundles or pills on surfaces, such as skin or fabric. As such, the use of such debonders can often result in a much weaker paper product during use that exhibits substantial amounts of lint and slough.

As such, a need currently exists for a paper product that is strong, soft, and that has low lint and slough.

SUMMARY OF THE INVENTION

In accordance with one embodiment of the present invention, a paper product is formed from at least one paper web. In particular, the paper web includes hardwood fibers (e.g., eucalyptus fibers). At least a portion of the hardwood fibers are treated with a first hydrolytic enzyme capable of hydrolyzing the hardwood fibers to form aldehyde groups predominantly on the surface of the hardwood fibers. For example, in some embodiments, the dosage of the first hydrolytic enzyme is from about 0.1 to about 10 s.e.u. per gram of oven-dried pulp.

In addition, in some embodiments, the paper web can also include other types of fibers, such as softwood pulp fibers. In one embodiment, at least a portion of the softwood fibers are treated with a second hydrolytic enzyme capable of randomly hydrolyzing the softwood fibers to form aldehyde groups predominantly on the surface of the softwood fibers.

The enzyme-treated fibers can provide additional strength to the paper web such that lint and slough can be minimized. In addition, other ingredients, such as cross-linking agents, debonders, strength agents, and the like, can also be utilized to form paper webs having certain attributes. For instance, the above-mentioned additives can be applied to the first layer, second layer, and/or third layer of a multilayered paper web.

For example, in some embodiments, a cross-linking agent containing two or more hydroxy moieties can be used to form glycosidic bonds with the aldehyde groups formed predominantly on the surface of the cellulosic and/or hemicellulosic fibers. For instance, one or more starches may be utilized to form glycosidic bonds with the aldehyde groups. In some embodiments, natural or modified starches can be utilized. One such commercially available starch can be obtained from National Starch and Chemical Company (Bridgeport, N.J.) under the trade designation "Redibond 2380A".

As stated above, a debonder may also be applied to the paper web. In some embodiments, the debonder can be applied in amounts up to 35 pounds per metric ton of total fibrous material (lb/MT), particularly between about 1 lb/MT to about 10 lb/MT, and more particularly between about 2 lb/MT to about 8 lb/MT.

In general, any material that can be applied to cellulosic fibers or a paper web and that is capable of enhancing the soft feel of a paper product by disrupting hydrogen bonding can generally be used as a debonder in the present invention. For instance, one commercially available imidazoline debonder is available from McIntyre Group, Ltd. under the trade designation "Mackernium DC-183".

If desired, a strength agent (i.e., wet-strength or dry-strength) can also be utilized, in some embodiments, to further increase the strength of the paper product. For example, in some embodiments, the strength agent can be applied in amounts up to 20 pounds per metric ton of total fibrous material (lb/MT), particularly between about 1 lb/MT to about 10 lb/MT, and more particularly between about 2 lb/MT to about 6 lb/MT. One commercially available wet strength agent, for example, that can be used in the present invention is "Kymene 557LX", which is sold by Hercules, Inc.

Additives, such as described above, can generally be applied at various of stages of a papermaking process. For instance, in some embodiments, the additives can be applied prior to forming the web (i.e., added to the pulper, dump chest, machine chest, clean stock chest, low density cleaner, added directly into the head box, etc.). Moreover, if desired, the additives can be applied after web formation as well (i.e., onto the web after being deposited by the headbox, onto a forming or transfer fabric or felt, at the drier, the during the converting stage, etc.). For instance, in one particular embodiment, an additive, such as a debonder, can be applied to a dryer drum such that the additive is transferred to the web when the web traverses over the drum during drying.

Other features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
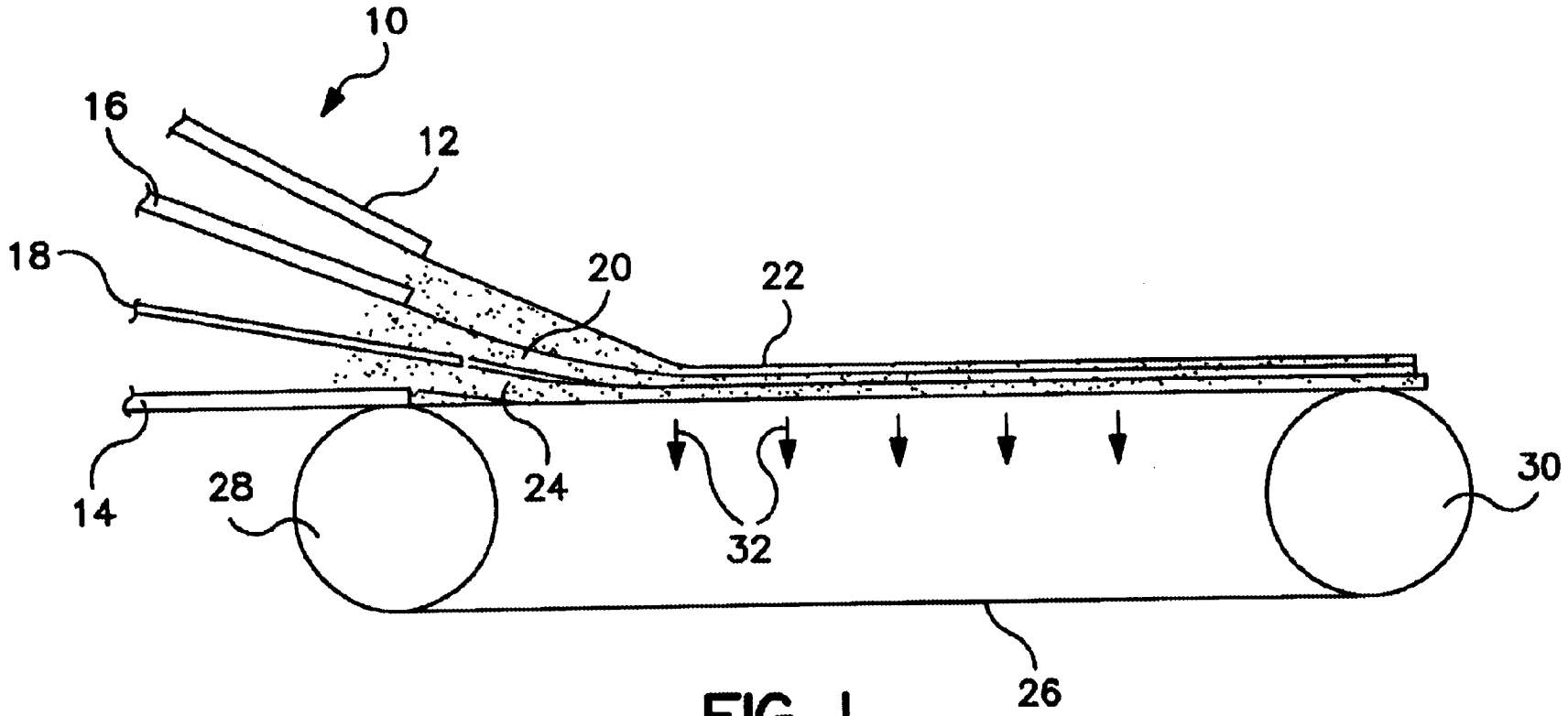
FIG. 1 is illustrates one embodiment of a headbox that can be used in the present invention.

Repeat use of reference characters in the present specification and drawings is intended to represent same or analogous features or elements of the present invention.

DETAILED DESCRIPTION OF REPRESENTATIVE EMBODIMENTS

Reference now will be made in detail to various embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents.

In general, the present invention is directed to a paper product that is strong, soft, and produces low amounts of lint and slough. In particular, the paper product includes hardwood fibers (e.g., eucalyptus fibers) treated with a hydrolytic enzyme and other fibers, such as softwood fibers (e.g., northern softwood kraft fibers), recycled fibers, etc., that may or may not also be treated with a hydrolytic enzyme. In one embodiment, the paper product includes a paper web having at least one layer formed primarily from hardwood fibers. The enzyme-treated hardwood fibers can provide additional strength to the paper web such that lint and slough can be minimized, while the hardwood fibers can help to provide a product that is soft. In addition, other ingredients, such as cross-linking agents, debonders, strength-agents, and the like, can also be selectively utilized to form paper webs having certain attributes.

A paper product, such as facial tissue, bath tissue, napkins, paper towels, wipes, writing paper, napkins, typing paper, paper board, etc., can generally be formed in accordance with the present invention from at least one paper web. For example, in one embodiment, the paper product can contain a single-layered paper web formed from a blend of fibers. In another embodiment, the paper product can contain a multi-layered paper (i.e., stratified) web. Furthermore, the paper product can also be a single- or multi-ply product (e.g., more than one paper web), wherein one or more of the plies may contain a paper web formed according to the present invention. Normally, the basis weight of a paper product of the present invention is between about 10 to about 400 grams per square meter (gsm). For instance, tissue products (e.g., towels, facial tissue, bath tissue, etc.) typically have a basis weight less than about 120 gsm, and in some embodiments, between about 10 to about 70 gsm.

Any of a variety of materials can be used to form the paper product of the present invention. For example, the material used to make the paper product can include fibers formed by a variety of pulping processes, such as kraft pulp, sulfite pulp, thermomechanical pulp, etc.

In some embodiments, the pulp fibers may include softwood fibers having an average fiber length of greater than 1 mm and particularly from about 2 to 5 mm based on a length-weighted average. Such softwood fibers can include, but are not limited to, northern softwood, southern softwood, redwood, red cedar, hemlock, pine (e.g., southern pines), spruce (e.g., black spruce), combinations thereof, and the like. Exemplary commercially available pulp fibers suitable for the present invention include those available from Kimberly-Clark Corporation under the trade designations "Longlac-19".

In some embodiments, hardwood fibers, such as eucalyptus, maple, birch, aspen, and the like, can also be used. In certain instances, eucalyptus fibers may be particularly desired to increase the softness of the web. Eucalyptus fibers can also enhance the brightness, increase the opacity, and change the pore structure of the paper to increase the wicking ability of the paper web. Moreover, if desired, secondary fibers obtained from recycled materials may be used, such as fiber pulp from sources such as, for example, newsprint, reclaimed paperboard, and office waste. Further, other natural fibers can also be used in the present invention, such as abaca, sabai grass, milkweed floss, pineapple leaf, and the like. In addition, in some instances, synthetic fibers can also be utilized. Some suitable synthetic fibers can include, but are not limited to, rayon fibers, ethylene vinyl alcohol copolymer fibers, polyolefin fibers, polyesters, and the like.

As stated, the paper product of the present invention can be formed from one or more paper webs. The paper webs can be single-layered or multi-layered. For instance, in one embodiment, the paper product contains a single-layered paper web layer that is formed from a blend of fibers. For example, in some instances, eucalyptus and softwood fibers can be homogeneously blended to form the single-layered paper web.

In another embodiment, the paper product can contain a multi-layered paper web that is formed from a stratified pulp furnish having various principal layers. For example, in one embodiment, the paper product contains three layers where one of the outer layers includes eucalyptus fibers, while the other two layers include northern softwood kraft fibers. In another embodiment, one outer layer and the inner layer can contain eucalyptus fibers, while the remaining outer layer can contain northern softwood kraft fibers. If desired, the three principle layers may also include blends of various types of fibers. For example, in one embodiment, one of the outer layers can contain a blend of eucalyptus fibers and northern softwood kraft fibers. However, it should be understood that the multi-layered paper web can include any number of layers and can be made from various types of fibers. For instance, in one embodiment, the multi-layered paper web can be formed from a stratified pulp furnish having only two principal layers.

In accordance with the present invention, various properties of a paper product such as described above, can be optimized. For instance, strength (e.g., wet tensile, dry tensile, tear, etc.), softness, lint level, slough level, and the like, are some examples of properties of the paper product that may be optimized in accordance with the present invention. However, it should be understood that each of the properties mentioned above need not be optimized in every instance. For example, in certain applications, it may be desired to form a paper product that has increased strength without regard to softness.

In this regard, in one embodiment of the present invention, at least a portion of the fibers of the paper product can be treated with hydrolytic enzymes to increase strength and reduce lint and slough. In particular, the hydrolytic enzymes can randomly react with the cellulose chains at or near the surface of the papermaking fibers to create single aldehyde groups on the fiber surface which are part of the fiber. These aldehyde groups become sites for cross-linking with exposed hydroxyl groups of other fibers when the fibers are formed and dried into sheets, thus increasing sheet strength. In addition, by randomly cutting or hydrolyzing the fiber cellulose predominantly at or near the surface of the fiber, degradation of the interior of the fiber cell wall is avoided or minimized. Consequently, a paper product made from these fibers alone, or made from blends of these fibers with untreated pulp fibers, show an increase in strength properties such as dry tensile, wet tensile, tear, etc.

Some hydrolytic enzymes useful for purposes of this invention are those enzymes which randomly hydrolyze cellulose and/or hemicellulose to create aldehyde groups. For example, enzymes that hydrolyze (beta)-1,4-glucosidic linkages of cellulosic chains to create aldehyde groups may be particularly useful. Such enzymes include, without limitation, cellulases having carboxymethylcellulase activity, hemicellulases, endo-cellulases, endo-hemicellulases and endo-glucanases. If these enzymes are not freed of their cellulose binding domain ("truncated"), they may require the presence of a surfactant to attain the desired hydrolysis. Cellulose binding domains have been described in "Enzymatic Degradation of Insoluble Carbohydrates", P. Tomme, et al., J. N. Saddleer & M. H. Penner (eds.), ACS Symposium Series, No. 618. Particularly suitable enzymes are truncated endo-glucanases, which do not require the presence of a surfactant.

In some embodiments, single component cellulases (e.g., truncated endo-glucanases) are sometimes desired over multi-component cellulases (i.e., mixtures of cellulases) because of their purity and hence greater treatment control resulting in minimal cell wall damage. Suitable commercially available truncated endo-glucanases are sold by NovoNordisk BioChem North America, Inc., under the name Novozyme® 613, SP-613, SP-988, or NS 51016. Still, other hydrolytic enzymes, natural or man-made, which possess or emulate carboxymethylcelellulase activity and are deprived of their cellulosic binding domain, will essentially produce similar results. Moreover, truncated multi-component cellulases may also work well. For example, a cellulase mixture of endo-glucanases and exo-glucanases may be suitable because the reactivity of the exo-glucanase portion is restricted by chance.

As mentioned above, if the hydrolytic enzyme is not truncated, the presence of a surfactant is preferred in the enzyme treatment step for optimal results. A preferred surfactant is a nonionic surfactant, commercially available Tween® 80 (ICI Specialties) or any of the other Tween®60 series products which are POE sorbitan derivatives. Other suitable nonionic surfactants include DI600® from High Point Chemical Corp.; DI600® is an alkoxylated fatty acid. Furthermore, aryl alkyl polyetheralcohol, such as Union Carbide's Triton®X-100 series of surfactants; alkyl phenyl ether of polyethylene glycol, such as Union Carbide's Tergitol® series of surfactants; alkylphenolethylene oxide condensation products, such as Rhone Poulenc, Incorporated's Igepale® series of surfactants, and the like, can all be utilized.

In some cases, an anionic surfactant may be used depending on the type of pulp used. Examples of suitable anionic surfactants are: ammonium or sodium salts of a sulfated ethoxylate derived from a 12 to 14 carbon linear primary alcohol, such as Vista's Alfonic® 1412A or 1412S; and sulfonated naphthalene formaldehyde condensates, such as Rohm and Haas's Tamol® SN. In some cases, a cationic surfactant can be used, especially when debonding is also desired. Suitable cationic surfactants include imidazole compounds, e.g., Ciba-Geigy's Amasoft® 16-7 and Sapamine® P quaternary ammonium compounds; Quaker Chemicals' Quaker® 2001; and American Cyanamid's Cyanatex®.

If present, the amount of surfactant added to the pulp fibers, can be from about 0.5 to about 6 pounds per metric ton of pulp, and more specifically from about 2 to about 3 pounds per metric ton of pulp. The specific amount will vary depending upon the particular enzyme being used and the enzyme dosage.

The amount of enzyme administered can be denoted in terms of its activity (in enzymatic units per mass or volume) per mass of dry pulp. In general, endo-glucanase activity ("carboxymethylcellulase" activity) in cellulases can be assayed in absolute terms by viscosimetry using a carboxymethylcellulose as a substrate, as explained in papers by K. E. Almin and K. -E. Eriksson (Biochim. Biophys Acta, Vol. 139 (1967), 238) and K. E. Almin, K. -E. Eriksson and C. Jansson (Biochim. Biophys. Acta, Vol.139 (1967), 248). One standard enzyme unit (s.e.u.) of endo-glucanase is defined as the amount of enzyme (expressed in unit mass or unit volume) that catalyzes the initial hydrolysis of one microequivalent of β-1,4-glucosidic bonds per minute of a defined carboxymethylcellulose preparation of known degree of substitution, such as Aqualon 7H3SXF® (Hercules Incorporated), at a buffered pH of 5.0 and at a temperature of 25° C.

For purposes of this invention, enzyme dosages can generally vary depending on the desired properties of the resulting paper product. In particular, lower levels of enzyme treatment may be utilized to obtain a softer paper product. For example, in some embodiments, the amount of enzyme utilized in one paper web layer can be from about 0.1 to about 10.0 s.e.u. per gram of oven-dried pulp, in some embodiments from about 0.1 to about 5.0 s.e.u., in some embodiments from about 0.1 to about 2.0 s.e.u., and in some embodiments, from about 0.1 to about 0.5 s.e.u.

The consistency of an aqueous fiber suspension (weight percent fiber in the total pulp slurry) that is treated with an enzyme can be accommodated to meet usual paper mill practices. For example, relatively low consistencies, such as about 1% or lower, can be utilized. Moreover, in some embodiments, consistencies as high as 16% can show sufficient enzyme activity in a pulper. Although not required, in most embodiments, the aqueous fiber suspension is treated with an enzyme while at a consistency in the range of about 3 to about 10%. Mixing is generally desirable to achieve initial homogeneous dispersion and continuous contact between the enzyme and the substrate.

The reaction conditions for the enzymes vary, but are typically chosen to provide a pH of about 4 to about 9, and more specifically from about 6.5 to about 8. Moreover, temperatures can also vary, but typically range from about 0° C. (above freezing) to about 70 ° C. However, certain enzymes, such as thermostabilized endo-glucanases, may react effectively at higher temperatures (such as at the boiling point of water). Moreover, other enzymes, such as alkali-stabilized endo-glucanases, may react more efficiently at relatively high pH ranges, such as at a pH of about 12 to about 14.

Reaction times are also very flexible and can depend on the application of enzyme and on the desired extent of the modification. If the reaction time is kept short, fiber cell wall damage can sometimes be avoided, even with regular cellulases especially in the presence of surfactants. In general, suitable reaction times can be from about 15 to about 60 minutes or greater. In some embodiments, the reaction can be stopped at a desired point by denaturing the enzyme with an additive, such as sodium hypochlorite, hydrogen peroxide, chlorine dioxide, and the like. Other processes may be utilized to stop the reaction as well.

A measure of the effectiveness of the enzyme treatment is the increase in the "copper number". The copper number is defined as the number of grams of cuprous oxide resulting from the reduction of cupric sulfate by 100 grams of pulp. The procedure for determining the copper number is described in TAPPI Standard T 430 om-94 "Copper Number of Pulp". Historically, copper number determinations have been used to detect damage to cellulose after hydrolytic or specific oxidative treatments. An increase in reducing groups can indicate deterioration that will have a detrimental impact on mechanical strengths, since the evolution of aldehyde groups has been normally proportional to the random split of the cellulose chain and the decrease of its degree of polymerization throughout the fiber. However, for purposes of this invention, the copper number measures the improvement in the cross-linking ability of the fibers since the chemical modification is substantially restricted to the surface or the surface-near region of the fibers so as to maintain the integrity of the fiber cell walls. In general, the fibers treated in accordance with this invention have a copper number of about 0.10 or more grams of cuprous oxide per 100 grams of oven-dried pulp, more specifically from about 0.10 to about 1.0 gram of cuprous oxide per 100 grams of oven-dried pulp, and still more specifically from about 0.15 to about 0.50 gram of cuprous oxide per 100 grams of oven-dried pulp. For example, the copper number of the fibers typically correlates to the tensile strength of a web formed with the fibers such that the tensile strength increases with the copper number.

When utilizing enzyme-treated fibers, such as described above, a cross-linking agent may, in some embodiments, also be used to further increase the strength and reduce the lint and slough of the paper product. For example, in some embodiments, a cross-linking agent containing one or more hydroxy moieties can be used to form glycosidic bonds with the aldehyde groups formed predominantly on the surface of the cellulosic and/or hemicellulosic fibers.

In general, any compound that is capable of forming a bond with the aldehyde groups formed predominantly on the surface of the cellulosic and/or hemicellulosic fibers by the treatment of an enzyme can be used as a cross-linking agent in the present invention. In most embodiments, the cross-linking agent is also water-soluble to facilitate application to a fibrous slurry. Moreover, the cross-linking agent may also be cationic, anionic, nonionic, or amphoteric.

For example, in one embodiment, one or more starches may be utilized to form glycosidic bonds with the aldehyde groups. In some embodiments, natural starches can be utilized. Natural starches generally include reserve polysaccharides found in plants (e.g., corn, wheat, potato and the like) that can have linear (amylose) and/or branched (amylopectin) polymers of alpha-D-glucopyranosyl units. As is known in the art, natural starches from different plants can contain different levels of amylose and amylopectin. Although different starches containing different levels of the two glucopyranosyl units can be employed in the present invention, desirable starches contain at least about 20 wt. % of amylose, and more desirably at least about 25 wt. % of amylose, based on the total starch weight. One such commercially available starch can be obtained from National Starch under the trade designation "Redibond 2380A".

In addition to the starches mentioned above, other starches may be utilized as well. For example, modified starches, such as those available from National Starch and marketed as Co-Bond 1000 may be utilized. It is believed that these and related starches are covered by U.S. Pat. No. 4,675,394 to Solarek et al., which is incorporated herein in its entirety by reference thereto for all purposes. Derivatized dialdehyde starches, such as described in Japanese Kokai Tokkyo Koho JP 03,185,197, may also be used in the present invention.

When adding a starch, such as described above, to the enzyme-treated cellulosic and/or hemicellulosic fibers, the hydroxy moieties of the starch can act as a "bridge" between the aldehyde groups of two or more enzyme-treated fibers. For example, one hydroxy moiety of the starch can form a glycosidic bond with an aldehyde moiety of one enzyme-treated fiber, while another hydroxy moiety of the starch can form a glycosidic bond with an aldehyde moiety of another enzyme-treated fiber. As a result, the fibers within the paper web can become cross-linked to further improve the wet and/or dry strength of the web.

The cross-linking agent can generally be applied in any of a variety of amounts to achieve a paper product having a desired level of strength. For example, in some embodiments, the cross-linking agent can be applied in amounts up to 20 pounds per metric ton of total fibrous material within a given layer (lb/MT), particularly between about 1 lb/MT to about 15 lb/MT, and more particularly between about 1 lb/MT to about 10 lb/MT. Moreover, the cross-linking agent can also be applied to one or more layers of the tissue product. For instance, in one embodiment, the cross-linking agent can be applied to an outer layer of a three-layered paper web that contains enzyme-treated eucalyptus fibers.

In addition to the above mechanisms for varying the properties of a paper product, a chemical debonder or softening agent may also be utilized to enhance the softness of the resulting paper product. When utilized, a chemical debonder can reduce the amount of hydrogen bonds within one or more layers of a paper product; which result in a softer product. For instance, in one embodiment, a three-layered paper web can contain an outer layer of enzyme-treated eucalyptus fibers that is treated with a debonder. In another embodiment, a three-layered paper web can contain an inner layer of eucalyptus fibers that is treated with a debonder.

Depending on the desired characteristics of the resulting paper product, the debonder can also be utilized in varying amounts. For example, in some embodiments, the debonder can be applied in amounts up to 35 pounds per metric ton (lb/MT) of total fibrous material within a given layer, particularly between about 1 lb/MT to about 10 lb/MT, and more particularly between about 2 lb/MT to about 8 lb/MT. Moreover, the debonder can also be applied to one or more layers of a multi-layered paper web.

In general, any material that can be applied to cellulosic fibers or a paper web and that is capable of enhancing the soft feel of a paper product by disrupting hydrogen bonding can generally be used as a debonder in the present invention. Some examples of suitable debonders can include, but are not limited to, quaternary ammonium compounds, imidazolinium compounds, bis-imidazolinium compounds, diquaternary ammonium compounds, polyquaternary ammonium compounds, phospholipid deriviatives, polydimethylsiloxanes and related cationic and non-ionic silicone compounds, fatty & carboxylic acid derivatives, mono- and polysaccharide derivatives, polyhydroxy hydrocarbons, etc. Still other suitable debonders are disclosed in U.S. Pat. No. 5,529,665 to Kaun and U.S. Pat. No. 5,558,873 to Funk. et al., which are incorporated herein in their entirety by reference thereto for all purposes. In particular, Kaun discloses the use of various cationic silicone compositions as softening agents. One commercially available debonder is available from McIntyre Group, Ltd. under the trade designation "Mackernium DC-183".

As stated above, the utilization of enzyme-treated fibers and/or a cross-linking agent, for example, can provide a paper product with enhanced strength (e.g., dry tensile, wet tensile, tear, etc.). In addition, a strength agent (i.e., wet-strength or dry-strength) can also be utilized, in some embodiments, to further increase the strength of the paper product. Depending on the desired characteristics of the resulting paper product, the strength agent can also be utilized in varying amounts. For example, in some embodiments, the strength agent can be applied in amounts up to 20 pounds per metric ton of total fibrous material within a given layer (lb/MT), particularly between about 1 lb/MT to about 10 lb/MT, and more particularly between about 2 lb/MT to about 6 lb/MT. Moreover, the strength agent can also be applied to one or more layers of the paper product. For instance, in one embodiment, the strength agent can be applied to each layer of a three-layered paper web.

Any of a variety of conventional strength agents may generally be used in the present invention. For instance, some strength agents that may be used in the present invention include, but are not limited to, latex compositions; such as acrylates, vinyl acetates, vinyl chlorides, and methacrylates; polyamine/amide epichlorohydrins, epoxides, polyethyleneimines, etc.

Moreover, when utilizing a wet-strength agent, permanent and/or temporary wet-strength agents may be utilized. Some conventional permanent wet-strength agents are described in U.S. Pat. Nos. 2,345,543, 2,926,116; and 2,926,154. Other permanent wet-strength agents that can be used in the present invention include polyamine-epichlorohydrin, polyamide epichlorohydrin or polyamide-amine epichlorohydrin resins, which are collectively termed "PAE resins." These materials have been described in U.S. Pat. No. 3,700,623 to Keim and U.S. Pat. No. 3,772,076 to Keim, which are incorporated herein in their entirety by reference thereto for all purposes and are sold by Hercules, Inc., Wilmington, Del., as "Kymene" e.g., Kymene 557H or Kymene 557LX.

As stated, temporary wet-strength agents may also be utilized in the present invention. Some suitable conventional temporary wet-strength agents can include, but are not limited to, dialdehyde starch, polyethylene imine, mannogalactan gum, glyoxal, and dialdehyde mannogalactan. Other suitable temporary wet-strength agents are described in U.S. Pat. No. 3,556,932 to Coscia et al.; U.S. Pat. No. 5,466,337 to Darlington, et al., U.S. Pat. No. 3,556,933 to Williams et al., U.S. Pat. No. 4,605,702 to Guerro et al., U.S. Pat. No. 4,603,176 to Bjorkquist et al., U.S. Pat. No. 5,935,383 to Sun, et al., and U.S. Pat. No. 6,017,417 to Wendt, et al., which are incorporated herein in their entirety by reference thereto for all purposes.

Besides the above-mentioned materials, it should be understood that any other additive, agent, or material can be added to a paper product of the present invention, if desired. For example, various additives can be applied to a paper product of the present invention to aid in retention of the debonder. Examples of such retention aids are described in U.S. Pat. No. 5,830,317 to Vinson et al., which is incorporated herein in its entirety by reference thereto for all purposes.

A paper product made in accordance with the present invention can generally be formed according to a variety of papermaking processes known in the art. In fact, any process capable of making a paper web can be utilized in the present invention. For example, a papermaking process of the present invention can utilize wet-pressing, creping, through-air-drying, creped through-air-drying, uncreped through-air-drying, single recreping, double recreping, calendering, embossing, as well as other steps in processing the paper web.

In some embodiments, in addition to the use of various chemical treatments, such as described above, the papermaking process itself can also be selectively varied to achieve a paper product with certain properties. For instance, a papermaking process can be utilized to form a multi-layered paper web, such as described and disclosed in U.S. Pat. No. 5,129,988 to Farrington, Jr. and U.S. Pat. No. 5,494,554 to Edwards, et al., which are both incorporated herein in their entirety by reference thereto for all purposes. Moreover, in other instances, the papermaking process can be utilized to form a single-layered paper web containing a blend of fibers.

In this regard, various embodiments of a method for forming a paper product of the present invention will now be described in more detail. Initially, one or more fiber furnishes are provided. For instance, in one embodiment, two fiber furnishes are utilized. Although other fibers may be utilized, the first fiber furnish typically contains hardwood fibers, such as eucalyptus fibers. Moreover, in some embodiments, the second fiber furnish can contain softwood fibers (e.g., northern softwood kraft fibers) and/or recycled fibers. In some embodiments, a third fiber furnish containing either hardwood, softwood, recycled fibers, etc., can also be utilized.

In one embodiment, while at a relatively low solids consistency (e.g., 4–5%), one or more of the fiber furnishes is treated with an enzyme as described above. For example, in some instances, the first fiber furnish and second fiber furnish are both treated with a truncated endo-glucanase hydrolytic enzyme. In some embodiments, only the first fiber furnish is treated with an enzyme. Moreover, in still other embodiments, neither of the furnishes are initially treated with an enzyme. Further, if desired, an additive, such as a cross-linking agent, can also be supplied to the first and second fiber furnishes to further increase the strength of the resulting paper web.

The above fiber furnishes can then be fed to separate pulpers that disperse the fibers into individual fibers. The pulpers can run continuously or in a batch format to supply fibers to the papermaking machine. Once the fibers are dispersed, the furnishes can then, in some embodiments, be pumped to a dump chest and diluted to about a 3–4% consistency. For example, in one embodiment, the first fiber furnish containing enzyme-treated hardwood fibers is transferred to a dump chest. Thereafter, the first fiber furnish can be transferred directly to a clean stock chest, where it is diluted to a consistency of about 2–3%. If desired, additives, such as debonders, cross-linking agents, strength-enhancing agents, etc., can also be added to the dump chest and/or clean stock chest to enhance the properties of the finished product.

In other embodiments, one or more of the fiber furnishes may also be refined prior to being utilized in the paper web. For example, one type of refining technique known as fibrillation can be utilized. Fibrillation generally refers to the creation of fibril elements on the surface of the fibers. Fibrillation can be accomplished through mechanical agitation, such as described in U.S. Pat. No. 4,608,292 to Lassen or U.S. Pat. No. 4,761,237 to Lassen, which are incorporated herein in their entirety by reference thereto for all purposes, as well as through other methods, such as by contacting the fibers with a fibrillation-inducing medium. For instance, U.S. Pat. No. 5,759,926 to Pike et al., U.S. Pat. No. 5,895,710 to Sasse et al., and U.S. Pat. No. 5,935,883 to Pike, which are incorporated herein in their entirety by reference thereto for all purposes, describe a variety of fibrillation-inducing mediums that can be used in the present invention, such as hot water, steam, air/steam mixtures, etc.

If desired, various additives, such as debonders, cross-linking agents, or other strength-enhancing agents, can also be added to improve the sheet integrity and softness. The furnishes can further be diluted, if desired, to about 0.1% consistency at the fan pump prior to entering the headbox.

To form a single-layered paper web, the fiber furnishes, such as described above, can be blended (homogeneously mixed) and then supplied to a headbox. For instance, in one embodiment, a fiber furnish containing enzyme-treated hardwood fibers is blended with a fiber furnish containing enzyme-treated softwood fibers in a machine chest, which is utilized to store the blend until it supplied to a papermaking headbox. Other additives, such as described above, may also be utilized. In another embodiment, a furnish containing untreated hardwood fibers is blended with a furnish containing untreated softwood fibers to form a blend. The blend may then be applied with enzymes or other additives, such as described above.

Moreover, in one embodiment, to form a multilayered paper web, the fiber furnishes are then supplied to a headbox, such as shown in FIG. 1, for distribution to a papermaking machine. As depicted in FIG. 1, a headbox 10 is provided that contains three-layers. In particular, the headbox 10 includes an upper head box wall 12 and a lower head box wall 14. The head box 10 further includes a first divider 16 and a second divider 18, to form three fiber stock layers.

Figure 2:
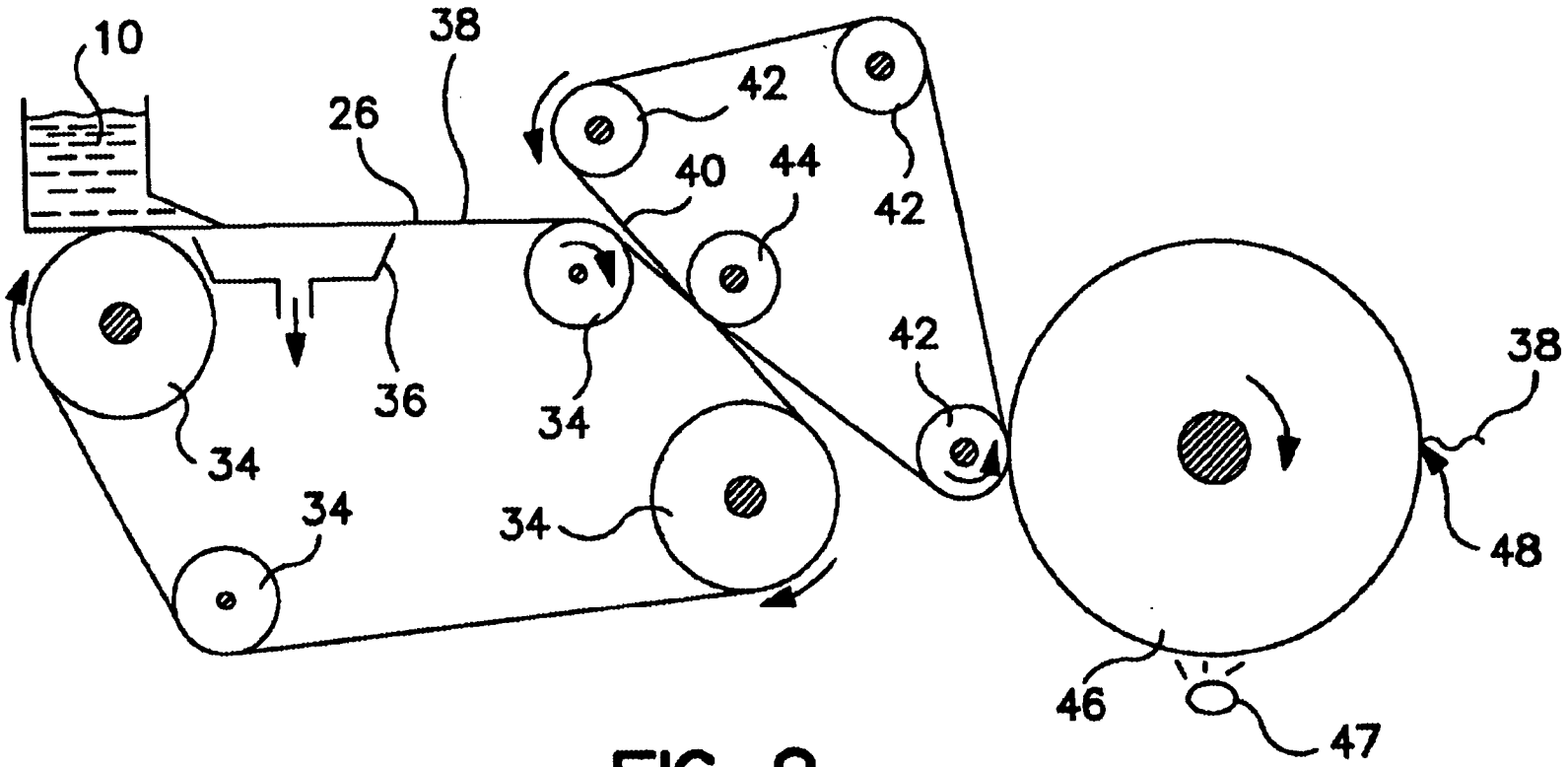
FIG. 2 illustrates one embodiment of a papermaking machine that can be used in the present invention to form a paper web.

Once supplied to a headbox, the single- or multi-layered furnishes are then supplied to a papermaking machine. For instance, referring to FIGS. 1–2, one embodiment of a papermaking machine that can be used in the present invention is illustrated. As shown, an endless traveling forming fabric 26, suitably supported and driven by rolls 28 and 30, receives the layered paper making stock issuing from the headbox 10. Once retained on the fabric 26, the fiber suspension passes water through the fabric as shown by the arrows 32. Water removal is achieved by combinations of gravity, centrifugal force and vacuum suction depending on the particular forming configuration.

From the forming fabric 26, a formed web 38 is transferred to a second fabric 40, which may be either a fabric or a felt. The fabric 40 is supported for movement around a continuous path by a plurality of guide rolls 42. Also included is a pick-up roll 44 designed to facilitate transfer of the web 38 from the fabric 26 to the fabric 40. Alternatively, besides the roll 44, a stationary pick-up shoe can also be used to facilitate transfer of the web. In some embodiments, the speed at which the fabric 40 is driven is approximately the same speed at which the fabric 26 is driven so that movement of the web 38 through the system is consistent.

From the fabric 40, in this embodiment, the web 38 is pressed into engagement with the surface of a rotational dryer drum 46, such as a Yankee dryer, to which it adheres due to its moisture content and its preference for the smoother of the two surfaces. In some cases, however, a creping adhesive, such as an ethylene vinyl acetate or polyvinyl alcohol, can be applied over the web surface or drum surface to facilitate attachment of the web to the drum. Moreover, other ingredients, such as dryer release agents, may also be utilized.

In some embodiments, certain additives can be applied to the paper web as the web traverses over the drum 46. For example, additives, such as debonders or strength agents, can be applied with a spray boom 47 to the surface of the drum 46 separately and/or in combination with the creping adhesives such that the additive is applied to an outer layer of the web as it passes over the drum 46.

The aqueous solution of additives and/or creping adhesives can be applied by conventional methods, such as through the use of a spray boom that evenly sprays the surface of the dryer with the creping adhesive solution. In some embodiments, the point of application on the surface of the dryer is the point immediately following the creping blade 48, thereby permitting sufficient time for the spreading and drying of the film of fresh adhesive before contacting the web in the press roll nip. Methods and techniques for applying an additive to a dryer drum are described in more detail in U.S. Pat. No. 5,853,539 to Smith, et al. and U.S. Pat. No. 5,993,602 to Smith, et al., which are incorporated herein in their entirety by reference thereto for all purposes.

In some instances, by applying the additive(s) to the paper web via the dryer drum 46, such as described above, the resulting paper product may be provided with certain beneficial properties. For example, in one embodiment, the paper web can contain a first outer layer of enzyme treated eucalyptus fibers and a middle layer and second outer layer of enzyme-treated softwood fibers. To soften the web, a debonder, such as described above, is often applied to one or more of the layers. By applying the debonder to the outer layer through the use of the dryer drum 46, the debonder can gradually penetrate through the web such that a strength gradient is formed. In particular, the outer layer that is first contacted with the debonder is debonded to a greater extent than the middle layer, and the middle layer is debonded to a greater extent than the other outer layer. Such an increasing strength gradient can allow the outer layer of eucalyptus to remain soft and also inhibit the production of lint and slough by maintaining strength in the other layers.

As the web 38 is carried through a portion of the rotational path of the dryer surface, heat is imparted to the web causing most of the moisture contained within the web to be evaporated. The web 38 is then removed from dryer drum 46 by a creping blade 48. Although optional, creping the web 38 as it is formed further reduces internal bonding within the web and increases softness.

In some embodiments, the web 38 can also be dried using non-compressive drying techniques, such as through-air drying. A through-air dryer accomplishes the removal of moisture from the web by passing air through the web without applying any mechanical pressure. Through-air drying can increase the bulk and softness of the web. Examples of such a technique are disclosed in U.S. Pat. No. 5,048,589 to Cook, et al.; U.S. Pat. No. 5,399,412 to Sudall, et al.; U.S. Pat. No. 5,510,001 to Hermans, et al.; U.S. Pat. No. 5,591,309 to Rugowski, et al.; and U.S. Pat. No. 6,017,417 to Wendt, et al., which are incorporated herein in their entirety by reference thereto for all purposes.

Although one of the embodiments discussed above relates to a multi-layered paper web having three layers, it should be understood that the paper web can contain any number of layers greater than or equal to two layers. For example, in one embodiment, the paper web can contain one layer of enzyme-treated eucalyptus fibers and another layer of enzyme-treated softwood fibers. In addition, it should also be understood that the layers of the multi-layered paper web can also contain more than one type of fiber. For example, in some embodiments, one of the layers can contain a blend of enzyme-treated hardwood fibers and untreated hardwood fibers, a blend of enzyme-treated hardwood fibers and softwood fibers, a blend of untreated hardwood fibers and enzyme treated softwood fibers, or a blend of untreated hardwood fibers and softwood fibers.

Moreover, additives, such as described above for use with single- and multi-layered paper webs, can generally be applied at various of stages of a papermaking process. For instance, in some embodiments, the additives can be incorporated into the paper web at the "wet end" of the process, such as being directly applied to the pulper, dump chest, machine chest, clean stock chest, low density cleaner, added directly into the head box, etc. Moreover, if desired, the additives can be applied at other stages of the wet end of a papermaking process, such as being applied to after web formation (i.e., after being deposited by the headbox). For instance, in one embodiment, discrete surface deposits of a debonding agent can be applied to the tissue, as described in U.S. Pat. No. 5,814,188 to Vinson, et al., which is incorporated herein in its entirety by reference thereto for all purposes. Moreover, if desired, additives may also be applied to the web during the converting stage (i.e., after being dried), through the use of methods such as printing, spraying, foaming, etc.

As stated above, a paper product of the present invention can be a single- or multi-ply paper product. When utilizing multiple plies, one or more of the plies may be formed in accordance with the present invention. For instance, in one embodiment, a two-ply paper product can be formed. The first and second ply, for example, can be a multilayered paper web formed according to the present invention. The configuration of the plies can also vary. For instance, in one embodiment, one ply can be positioned such that a layer of the ply containing hardwood fibers can define a first outer surface of the paper product to provide a soft feel to consumers. If desired, the other ply can also be positioned such that a layer of the ply containing hardwood fibers can define a second outer surface of the paper product.

The plies may be similarly configured when more than two plies are utilized. For example, in some embodiments, when forming a paper product from three plies, one outer ply can be positioned such that a layer of the ply containing hardwood fibers can define a first outer surface of the paper product to provide a soft feel to consumers. The other outer ply can also be positioned such that a layer of the ply containing hardwood fibers can define a second outer surface of the paper product. By forming the outer surfaces of a multi-ply product with a layer containing hardwood fibers according to the present invention, the resulting product can provide enhanced softness to consumers. However, it should also be understood that any other ply configuration may be utilized in the present invention.

The present invention may be better understood with reference to the following examples.

EXAMPLE 1

The ability to form multi-layered paper webs in accordance with the present invention was demonstrated. Initially, a first furnish containing "Longlac-19" softwood fibers, which are available from Kimberly-Clark Corporation, and a second furnish containing Brazilian eucalyptus bleached kraft pulp fibers were formed.

For certain layers of the samples (See Table I), a portion of one or both of the furnishes was then treated with Novozyme® SP-988 in a hydrapulper at 5% consistency, 45° C. and a pH of 5.5. In particular, the agitator was started and an enzyme dosage of 2.0 s.e.u., was added to the pulper for reaction with the pulp. The reaction was stopped after 40 minutes by denaturing the enzyme with sodium hypochlorite in an amount of 0.1% by weight of the pulp.

One sample (No. 2) was then made from the enzyme-treated LL-19 and/or the enzyme-treated eucalyptus to illustrate the improved properties of a multi-layered paper web of the present invention. In particular, each of the web samples was formed using a papermaking process, such as described above.

To enhance certain properties of the web, DC-183 (imidazoline debonder), Kymene® 557LX (wet strength agent), and National Starch Redibond 2380A (starch) were added in various amounts to one or more layers of the web, as indicated below in Table I. The starch was added to the pulper. The debonder was added to the hardwood fiber in the indicated layer by addition of a diluted amount directly to the dump chest after pulping. Moreover, the wet strength agent was also added to the indicated layer by continuous injection into the stock prior to being pumped to the headbox.

In addition to the sample mentioned above, another sample (No. 1) was also formed. In particular, one furnish that contained first furnish containing "Longlac-19" softwood fibers and a second furnish containing Brazilian eucalyptus bleached kraft pulp fibers were formed. Neither of the furnishes were treated with an enzyme or cross-linking agent. The softwood fibers were passed through a disk refiner to further enhance the strength of the fibers.

The web sample was then formed into a multi-layered paper web as described above. DC-183 (imidazoline debonder) and Kymene® 557LX (wet strength agent) were added in various amounts to one or more layers of the web, as indicated below in Table I. The debonder was added to the hardwood fiber in the indicated layer by addition of a diluted amount directly to the dump chest after pulping. Moreover, the wet strength agent was also added to the indicated layer by continuous injection into the stock prior to being pumped to the headbox.

Both of the samples were then formed into a 2-ply paper product having a basis weight of about 30 grams per square meter. Each 2-ply paper product contained two identical paper web samples where Layer A of each web formed the outer layer of the product (See Table I). For example, one paper product contained two plies where each ply was formed from web sample 2.

The characteristics of the resulting samples are given below in Table I.

TABLE I

Characteristics of Samples 1–2

| No. | Layer | Fiber Type | Fiber Content (wt. %) | EG Level (eu/g) | De-bonder (lb/MT) | Kymene (kg/MT) | Starch (kg/MT) |
|---|---|---|---|---|---|---|---|
| 1 | A | Euc. | 65.0 | 0.0 | 3.25 | 4.0 | 0.00 |
| | B | LL-19 | 17.5 | 0.0 | 0.0 | 4.0 | 0.00 |
| | C | LL-19 | 17.5 | 0.0 | 0.0 | 4.0 | 0.00 |
| 2 | A | Euc. | 65.0 | 2.0 | 3.25 | 4.0 | 7.50 |
| | B | LL-19 | 17.5 | 2.0 | 0.0 | 4.0 | 7.50 |
| | C | LL-19 | 17.5 | 2.0 | 0.0 | 4.0 | 7.50 |

Once formed, various properties of the samples were then tested. For example, the geometric mean tensile strength, slough, and stiffness were determined for the samples.

Geometric mean tensile strength ("GMT"): The GMT value for each sample was calculated as the square root of the product of the machine direction tensile strength and the cross-machine direction tensile strength. The units of GMT strength are grams per 3 inches of sample width, but are simply referred to herein as "grams". Tensile strengths were determined in accordance with TAPPI test method T 494 om-88 using flat gripping surfaces, a specimen width of 3 inches, a length of 4 inches, and a crosshead speed of about 10 inches per minute.

Figure 3:
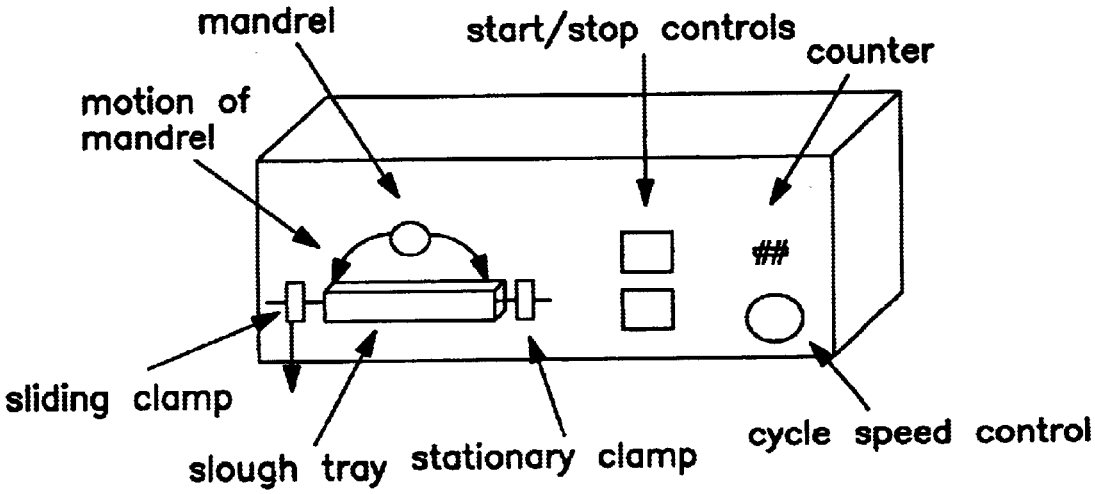
FIG. 3 is a perspective view of one embodiment of a test apparatus that can be used to determine slough according to one embodiment of the present invention.

Slough: The amount of slough was determined using a Scott Pilling Tester. The Scoff Pilling Tester measures the resistance of a paper product to abrasive action when the material is subjected to a horizontally reciprocating surface abrader. All samples were conditioned at 23° C.±1° C. and 50±2% relative humidity for a minimum of 4 hours. FIG. 3 shows a diagram of the test equipment.

Key elements of the instrument include an oscillating and rotating abrasive spindle, fixtures to hold the paper product across the spindle under a fixed load, a pan to collect material abraded off the paper, and electronics to control the duration and rate of the applied abrasion force to the surface of the paper. In addition, an analytical balance is required to determine the before and after weights of the abraded paper.

The abrading spindle includes a stainless steel rod that is 0.5" in diameter with the abrasive portion containing a 0.005" deep diamond pattern knurl extending 4.25" in length around the entire circumference of the rod. The spindle is mounted horizontally and perpendicularly to the face of the instrument such that the abrasive portion of the rod extends out its entire distance from the face of the instrument. A pan with dimensions of 0.5"×3.75"×3.5" is located directly underneath the area traversed by the spindle to collect material liberated during the abrading process. On each side of the spindle is located a clamp, one movable and one fixed, spaced 4" apart and centered about the spindle. The movable jaw (approximately 102.7 grams) is allowed to slide freely in the vertical direction such that the weight of the jaw provides the means for insuring a constant tension of the sample over the spindle surface.

The paper product is further supported on either side of the spindle by a raised element each with a smooth polished radius to insure minimal friction and uniform tension while the tissue is being abraded. The electronics include a control for the horizontal oscillation frequency of the spindle and a counter to control the number of oscillations. The clockwise rotation of the spindle (when looking at the front of the instrument) is at an approximate speed of 5 RPM.

Using a JDC-3 or equivalent precision cutter (Thwing-Albert Instrument Company, Philadelphia, Pa.) the specimens are cut into 3"±0.05" wide ×7" long strips. For paper samples, the MD direction. corresponds to the longer dimension. Each test strip is weighed to the nearest 0.1 mg prior to testing. One end of the sample is inserted into the fixed clamp, loosely draped over the spindle and inserted into the sliding clamp. The entire width of the tissue should be in contact with the abrading spindle. The movable jaw is then allowed to fall providing constant tension across the spindle.

When the instrument is started, the spindle moves back and forth at an approximate 15 degree angle from the centered vertical centerline in a reciprocal horizontal motion against the test strip for 20 cycles (each cycle is a back and forth stroke), at a speed of 170 cycles per minute. The distance traversed by the spindle is approximately 2 5/16" across the face of the tissue. Any loose fibers or tissue material will fall into the pan located below the spindle. The sample is then removed from the jaws and any loose fibers on the sample surface are removed by gently shaking the sample test strip. The test sample is then weighed to the nearest 0.1 mg. The weight loss is calculated by subtracting the weight of the paper after abrasion from the initial weight before abrasion. The weight loss is the reported value. Ten test strips per sample are tested and the average weight loss value in mg is recorded. The result for each example is compared with a control sample tested at the same time.

Stiffness: The stiffness of the samples was measured by group of trained panelists. The rated value listed in Table II was based comparative assessment of the sample with standard samples having a predetermined stiffness value. Samples with lower stiffness values generally represent softer samples.

The results for the above samples are summarized below in Table II.

TABLE II

Properties of Samples 1–2

| No. | GMT (grams) | Slough (mg) | Stiffness |
|---|---|---|---|
| 1 | 780 | 13.44 | 3.50 |
| 2 | 1060 | 3.50 | 5.40 |

Thus, the results above illustrate the ability to achieve a multi-layered paper web having certain beneficial properties in accordance with the present invention. For example, the multi-layered paper web of sample 2 had good strength and minimal slough production.

EXAMPLE 2

The ability to form multi-layered paper webs in accordance with the present invention was demonstrated. Initially, a first furnish containing "Longlac-19" softwood fibers, which are available from Kimberly-Clark Corporation, and a second furnish containing Brazilian eucalyptus bleached kraft pulp fibers were formed.

For certain layers of the samples (See Table III), a portion of one or both of the furnishes was then treated with Novozyme® SP-988 in a pulper at 5% consistency, 45° C. and a pH of 5.5. In particular, the agitator was started and an enzyme dosage of 0.5, 1.0, and 1.5 s.e.u. (depending on the sample), was added to the pulper for reaction with the pulp. The reaction was stopped after 40 minutes by denaturing the enzyme with sodium hypochlorite in an amount of 0.1% by weight of the pulp.

Four web samples (Nos. 4–8) were then made from the enzyme-treated LL-19 and/or the enzyme-treated eucalyptus to illustrate the improved properties of a multi-layered paper web of the present invention In particular, each of the web samples was formed using a papermaking process, such as described above.

To enhance certain properties of the web, DC-183 (imidazoline debonder), Kymene® 557LX (wet strength agent), and National Starch 2380A (starch) were added in various amounts to one or more layers of the web, as indicated below in Table III. For samples 4–8, the debonder was added to the hardwood fiber in the indicated layer by addition of a diluted amount directly to the dump chest after pulping. For samples 4–8, the starch was then added to the indicated layer by continuous injection into the stock prior to being pumped to the headbox. Moreover, after adding the starch, the wet strength agent was also added for samples 4–8 to the indicated layer by continuous injection into the stock prior to being pumped to the headbox.

Moreover, for sample 7, additional DC-183 imidazoline debonder was also added at the dryer. Specifically, the DC-183 debonder was prepared at 1% actives and pumped into a dryer coating mix tank at a rate of 524 cubic centimeters minute. The coating mix tank also contained polyvinyl alcohol (coating adhesive), Quaker® 2008 from Quaker Chemical Company (dryer release agent), and Kymene® 557LX (wet strength agent). The aqueous mixture was then sprayed onto a Yankee dryer such that the composition transferred to the web when contacted therewith, such as described above. Equal amounts of debonder were applied prior to the headbox and at the dryer (i.e., 3 lb/MT prior to the headbox and 3 lb/MT at the dryer).

In addition to the samples mentioned above, another sample (No. 3) was also formed. In particular, one furnish that contained first furnish containing "Longlac-19" softwood fibers and a second furnish containing Brazilian eucalyptus bleached kraft pulp fibers were formed. Neither of the furnishes were treated with an enzyme or cross-linking agent. The web sample was then formed into a multi-layered paper web as described above. DC-183 (imidazoline debonder), Kymene® 557LX (wet strength agent), and National Starch Redibond 2380A (starch) were added, in various amounts to one or more layers of the web, as indicated below in Table III. The debonder was added to the hardwood fiber in the indicated layer by addition of a diluted amount directly to the dump chest after pulping. The starch and wet-strength agent were then added to the indicated layer by continuous injection into the stock prior to being pumped to the headbox, as described above.

All of the chemical addition rates listed below in Table III were based on the amount fibers within each particular layer of the paper product.

All of the samples were then formed into a 2-ply paper product having a basis weight of about 30 grams per square meter. Each 2-ply paper product contained two identical paper web samples where Layer A of each web formed the outer layer of the product (See Table III). For example, one paper product contained two plies where each ply was formed from web sample 4.

The characteristics of the resulting samples are given below in Table III.

TABLE III

Characteristics of Samples 3–8

| No. | Layer | Fiber Type | Fiber Content (wt. %) | EG Level (eu/g) | De-bonder (lb/MT) | Kymene (kg/MT) | Starch (kg/MT) |
|---|---|---|---|---|---|---|---|
| 3 | A | Euc. | 65.0 | 0.0 | 6 | 2.0 | 0.00 |
| | B | LL-19 | 17.5 | 0.0 | 0.0 | 2.0 | 5.00 |
| | C | LL-19 | 17.5 | 0.0 | 0.0 | 2.0 | 5.00 |
| 4 | A | Euc. | 65.0 | 0.5 | 6.0 | 2.5 | 2.25 |
| | B | LL-19 | 17.5 | 0.5 | 0.0 | 2.5 | 2.25 |
| | C | LL-19 | 17.5 | 0.5 | 0.0 | 2.5 | 2.25 |
| 5 | A | Euc. | 32.5 | 1.5 | 6.0 | 2.5 | 3.50 |
| | B | Euc. | 32.5 | 0.0 | 0.0 | 0.0 | 0.00 |
| | C | LL-19 | 35.0 | 0.5 | 0.0 | 2.5 | 3.50 |
| 6 | A | Euc. | 32.5 | 0.0 | 6.0 | 2.5 | 0.00 |
| | B | Euc. | 32.5 | 1.5 | 6.0 | 2.5 | 4.50 |
| | C | LL-19 | 35.0 | 0.5 | 0.0 | 2.5 | 4.50 |
| 7 | A | Euc. | 65.0 | 1.0 | 6.0 | 2.5 | 0.00 |
| | B | LL-19 | 17.5 | 0.5 | 0.0 | 2.5 | 0.50 |
| | C | LL-19 | 17.5 | 0.5 | 0.0 | 2.5 | 0.50 |
| 8 | A | Euc. | 32.5/ 32.5 | 1.5/ 0.0 | 6.0 | 2.5 | 4.50 |
| | B | LL-19 | 17.5 | 0.5 | 0.0 | 2.5 | 4.50 |
| | C | LL-19 | 17.5 | 0.5 | 0.0 | 2.5 | 4.50 |

Once formed, various properties of the samples were then tested. For example, the geometric mean tensile strength, slough, and stiffness were determined for the samples as described above. Moreover, lint was determined as follows:

Gelbo Lint: The amount of lint for a given sample was determined according to the Gelbo Lint Test. The Gelbo Lint Test determines the relative number of particles released from a fabric when it is subjected to a continuous flexing and twisting movement. It is performed in accordance with INDA test method 160.1-92. A sample is placed in a flexing chamber. As the sample is flexed, air is withdrawn from the chamber at 1 cubic foot per minute for counting in a laser particle counter. The particle counter counts the particles by size for greater than 50 microns using six channels to size the particles. The results can be reported as the total particles counted over 10 consecutive 30 second periods, the maximum concentration achieved in one of the ten counting periods or as an average of the ten counting periods. The test may be applied to both woven and nonwoven fabrics and indicates the lint generating potential of a material.

The results are summarized below in Table IV.

TABLE IV

Properties of Samples 3–8

| No. | GMT (grams) | Gelbo Lint (>50 microns) | Slough (mg) | Stiffness |
|---|---|---|---|---|
| 3 | 652 | 560 | 9.80 | 3.44 |
| 4 | 656 | 307 | 7.30 | 3.53 |
| 5 | 639 | 181 | 5.30 | 3.81 |
| 6 | 652 | 952 | 5.80 | 3.45 |
| 7 | 735 | 417 | 7.20 | 3.75 |
| 8 | 615 | 611 | 7.70 | 3.55 |

Thus, the results above illustrate the ability to achieve a multi-layered paper web having certain beneficial properties in accordance with the present invention. For example, the multi-layered paper web of sample 7 had good strength and softness, while also having minimal lint and slough production.

EXAMPLE 3

The ability to form a single-layered paper web in accordance with present invention was demonstrated. Initially, a first furnish containing "Longlac-19" softwood fibers, which are available from Kimberly-Clark Corporation, and a second furnish containing Brazilian eucalyptus bleached kraft pulp fibers were formed.

The furnishes were blended and then treated with Novozyme® SP-988 in a hydrapulper at 5% consistency, 45° C. and a pH of 5.5. In particular, the agitator was started and an enzyme dosage of 2.0 s.e.u. was added to the pulper for reaction with the pulp. The reaction was stopped after 40 minutes by denaturing the enzyme with sodium hypochlorite in an amount of 0.1% by weight of the pulp.

Six handsheet samples (Nos. 11–16) having a basis weight of about 60 grams per square meter and sample were then made from the enzyme-treated LL-19 and the enzyme-treated eucalyptus to illustrate the improved properties of a paper web of the present invention. In particular, the samples were formed into handsheets on a square (9×9 inches) Valley Handsheet Mold (Voith Inc., Appleton, Wis.). The handsheets were couched off the mold by hand using a blotter and pressed wire-side up at 100 pounds per square inch for 1 minute. The handsheets were then dried, wire-side up, for 2 minutes to absolute dryness using a Valley Steam Hotplate (Voith Inc., Appleton, Wis.) and a standard weighted canvas cover having a lead-filled (4.75 pounds) brass tube at one end to maintain uniform tension. The resulting handsheets were then conditioned in a humidity controlled room (23° C., 50% relative humidity) prior to testing.

To enhance certain properties of the handsheet, DC-183 (imidazoline debonder) and National Starch Redibond 2380A (starch) were added in various amounts, as indicated below in Table V. The starch and debonder were added to the pulper.

In addition to the samples mentioned above, two other handsheet samples (Nos. 9–10) were also formed. In particular, one furnish that contained first furnish containing "Longlac-19" softwood fibers and a second furnish containing Brazilian eucalyptus bleached kraft pulp fibers were formed. Neither of the furnishes were treated with an enzyme or cross-linking agent. The web samples were then formed into paper web as described above. DC-183 (imidazoline debonder) and starch were also added in some instances, as indicated below in Table V. The debonder and starch were combined with the pulp fibers in the pulper.

The characteristics of the resulting samples are given below in Table V.

TABLE V

Characteristics of Samples 9–15

| No. | Euc. wt. % | LL-19 wt. % | EG Level (eu/g) | Debonder (kg/MT) | Starch (kg/MT) |
|---|---|---|---|---|---|
| 9 | 80 | 20 | 0 | 0 | 7.5 |
| 10 | 80 | 20 | 0 | 2 | 7.5 |
| 11 | 95 | 5 | 2 | 2 | 7.5 |
| 12 | 80 | 20 | 2 | 0 | 7.5 |
| 13 | 80 | 20 | 2 | 2 | 0 |
| 14 | 80 | 20 | 2 | 2 | 7.5 |
| 15 | 80 | 20 | 2 | 0 | 15 |
| 16 | 65 | 35 | 2 | 2 | 7.5 |

Once formed, various properties of the samples were then tested. For example, the tensile strength and slough were determined for the samples. The tensile strength was measured on 1" strips using a Sintech tensile tester and slough was determined as described above. The results are summarized below in Table VI.

TABLE VI

Properties of Samples 9–16

| No. | Tensile Strength (grams/inch) | Slough (mg) |
|---|---|---|
| 9 | 3247 | 568 |
| 10 | 2867 | 860 |
| 11 | 4039 | 292 |
| 12 | 4952 | 222 |
| 13 | 3940 | 340 |
| 14 | 4415 | 248 |
| 15 | 4657 | 192 |
| 16 | 4350 | 194 |

Thus, the results above illustrate the ability to achieve a single-layered paper web having certain beneficial properties in accordance with the present invention. For example, the paper web of sample 16 had good strength, while also having minimal slough production.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A method for forming a paper web that contains a first layer formed primarily from hardwood fibers, said method comprising:

treating said hardwood fibers with a first hydrolytic enzyme to hydrolyze said hardwood fibers and form aldehyde groups predominantly on the surface thereof, wherein the dosage of said first hydrolytic enzyme is from about 0.1 to about 10 s.e.u. per gram of oven-dried pulp, wherein said first hydrolytic enzyme comprises a cellulose-binding domain free endo-glucanase; and further treating said hardwood fibers with a cross-linking agent that forms a bond with said aldehyde groups on the surface of said hardwood fibers.

2. A method as defined in claim 1, wherein the dosage of said first hydrolytic enzyme is from about 0.1 to about 5 s.e.u. per gram of oven-dried pulp.

3. A method as defined in claim 1, wherein the dosage of said first hydrolytic enzyme is from about 0.1 to about 2 s.e.u. per gram of oven-dried pulp.

4. A method as defined in claim 1, wherein said first layer defines an outer surface of the paper web.

5. A method as defined in claim 1, wherein said first layer also contains softwood fibers.

6. A method as defined in claim 1, wherein said cross-linking agent is a starch.

7. A method as defined in claim 6, wherein said starch forms a glycosidic bond with said aldehyde groups.

8. A method as defined in claim 6, wherein said starch is a natural starch.

9. A method as defined in claim 1, wherein said paper web includes a second layer formed primarily of pulp fibers selected from the group consisting of softwood fibers, hardwood fibers, and combinations thereof.

10. A method as defined in claim 9, wherein said pulp fibers of said second layer are treated with a second hydrolytic enzyme capable of hydrolyzing said pulp fibers to form aldehyde groups predominantly on the surface of said pulp fibers.

11. A method as defined in claim 10, wherein said second layer contains softwood fibers.

12. A method as defined in claim 10, wherein said second layer contains hardwood fibers.

13. A method as defined in claim 10, wherein said second hydrolytic enzyme comprises a cellulose-binding domain free endo-glucanase.

14. A method as defined in claim 1, wherein a debonder is incorporated into said first layer.

15. A method as defined in claim 1, wherein a strength agent is incorporated into said first layer.

16. A method as defined in claim 1, wherein said first hydrolytic enzyme is a single-component enzyme.

17. A method as defined in claim 1, wherein said first hydrolytic enzyme is a multi-component enzyme.

18. A method for forming a paper web that contains a first layer and a second layer, said method comprising:

providing a first fibrous furnish containing hardwood fibers;

providing a second fibrous furnish containing pulp fibers selected from the group consisting of hardwood fibers, softwood fibers, and combinations thereof;

treating said first fibrous furnish with a cellulosic-binding domain free endo-glucanase to hydrolyze said hardwood fibers and form aldehyde groups predominantly on the surface thereof, wherein the dosage of said cellulosic-binding domain free endo-glucanase is from about 0.1 to about 10 s.e.u. per gram of oven-dried pulp;

further treating said first fibrous furnish with a cross-linking agent that forms a bond with said aldehyde groups on the surface of said hardwood fibers; and forming the paper web from said first fibrous furnish and said second fibrous furnish, said first fibrous furnish forming said first layer and said second fibrous furnish forming said second layer.

19. A method as defined in claim 18, wherein the dosage of said cellulosic-binding domain free endo-glucanase is from about 0.1 to about 5 s.e.u. per gram of oven-dried pulp.

20. A method as defined in claim 18, wherein the dosage of said cellulosic-binding domain free endo-glucanase is from about 0.1 to about 2 s.e.u. per gram of oven-dried pulp.

21. A method as defined in claim 18, wherein said first fibrous furnish also contains softwood fibers.

22. A method as defined in claim 18, wherein said cross-linking agent is a starch.

23. A method as defined in claim 22, wherein said starch forms a glycosidic bond with said aldehyde groups.

24. A method as defined in claim 22, wherein said starch is a natural starch.

25. A method as defined in claim 18, wherein said cross-linking agent is applied in an amount from about 1 to about 15 pounds per metric ton of the weight of the first fibrous furnish.

26. A method as defined in claim 18, wherein said cross-linking agent is applied in an amount from about 1 to about 10 pounds per metric ton of the weight of the first fibrous furnish.

27. A method as defined in claim 18, wherein a debonder is applied to said first fibrous furnish.

28. A method as defined in claim 18, wherein a strength agent is applied to said first fibrous furnish.

29. A method as defined in claim 18, wherein said second fibrous furnish is treated with a cellulosic-binding domain free endo-glucanase capable of hydrolyzing said pulp fibers to form aldehyde groups predominantly on the surface of said pulp fibers.

30. A method as defined in claim 29, wherein said second fibrous furnish contains softwood fibers.

31. A method as defined in claim 29, wherein said second fibrous furnish contains hardwood fibers.

32. A method for forming a paper web that contains a first layer formed primarily from hardwood fibers, said first layer defining an outer surface of the paper web, said method comprising:

treating said hardwood fibers with a cellulosic-binding domain free endo-glucanase to hydrolyze said hardwood fibers and form aldehyde groups predominantly on the surface thereof, wherein the dosage of said cellulosic-binding domain free endo-glucanase is from about 0.1 to about 5 s.e.u. per gram of oven-dried pulp; and further treating said hardwood fibers with a starch cross-linking agent that forms a glycosidic bond with said aldehyde groups on the surface of said hardwood fibers.

33. A method as defined in claim 32, wherein the dosage of said cellulosic-binding domain free endo-glucanase is from about 0.1 to about 2 s.e.u. per gram of oven-dried pulp.

34. A method as defined in claim 32, wherein said first layer also contains softwood fibers.

35. A method as defined in claim 32, wherein said starch is a natural starch.

36. A method as defined in claim 32, wherein said paper web includes a second layer formed primarily of pulp fibers selected from the group consisting of softwood fibers, hardwood fibers, and combinations thereof.

37. A method as defined in claim 36, wherein said pulp fibers of said second layer are treated with a cellulosic-binding domain free endo-glucanase capable of hydrolyzing said pulp fibers to form aldehyde groups predominantly on the surface of said pulp fibers.

38. A method as defined in claim 37, wherein said second layer contains softwood fibers.

39. A method as defined in claim 37, wherein said second layer contains hardwood fibers.

40. A method as defined in claim 37, wherein a debonder is incorporated into said first layer.

41. A method as defined in claim 37, wherein a strength agent is incorporated into said first layer.

* * * * *